United States Patent [19]

Tanel

[11] Patent Number: 4,653,206

[45] **Date of Patent: * Mar. 31, 1987**

[54] PIVOTING ATHLETIC SHOE FOR ARTIFICIAL TURF

[75] Inventor: Michael L. Tanel, Milwaukee, Wis.

[73] Assignee: Tanel Corporation, Milwaukee, Wis.

[ * ] Notice: The portion of the term of this patent subsequent to Mar. 25, 2003 has been disclaimed.

[21] Appl. No.: 800,713

[22] Filed: Nov. 22, 1985

Related U.S. Application Data

[63] Continuation-in-part of Ser. No. 565,746, Dec. 27, 1983, Pat. No. 4,577,422.

[51] Int. Cl.[4] ..... A43B 5/02; A43B 5/00; A43C 15/16

[52] U.S. Cl. ..... 36/126; 36/128; 36/134; 36/59 C; 36/67 R

[58] Field of Search ..... 36/32 R, 126, 127, 128, 36/129, 134, 59 C, 67 R, 67 A, 114

[56] References Cited

U.S. PATENT DOCUMENTS

| | | | |
|---|---|---|---|
| Re. 26,419 | 7/1968 | McAuliffe | 36/103 |
| 825,869 | 7/1906 | Sandeman | 36/132 |
| 844,057 | 2/1907 | Tillinghast | 36/132 |
| 1,552,022 | 9/1925 | Willson | 36/59 C |
| 1,736,576 | 11/1929 | Cable | 36/59 C |
| 2,261,785 | 11/1941 | Youmans | 36/73 |
| 2,365,027 | 12/1944 | Urbany | 36/59 C |
| 2,677,905 | 5/1954 | Dye | 36/128 |
| 2,678,507 | 5/1954 | Dye | 36/128 |
| 3,466,763 | 9/1969 | Levin | 36/92 |
| 3,707,047 | 12/1972 | Nedwick | 36/114 |
| 4,577,422 | 3/1986 | Tanel | 36/126 |

*Primary Examiner*—Werner H. Schroeder
*Assistant Examiner*—Steven N. Meyers
*Attorney, Agent, or Firm*—Peter N. Jansson

[57] ABSTRACT

A cleated athletic shoe for improved pivotability and traction on artificial turf. The sole of the shoe has a series of at least three, and preferably more, concentric annular projections, including a first annular projection encompassing nearly the entire ball-of-the-foot and toe portions of the sole and extending across the width of the sole and at least two additional annular projections spaced at progressively shorter radial locations. The enclosed sole areas are coincident with the main sole surface. Preferred embodiments include at least one and preferably more truncated-circle projections each of which are concentric with the first projection but at greater radial locations.

14 Claims, 7 Drawing Figures

PIVOTING ATHLETIC SHOE FOR ARTIFICIAL TURF

RELATED APPLICATION

This is a continuation-in-part of my copending U.S. patent application Ser. No. 565,746, filed Dec. 27, 1983, now U.S. Pat. No. 4,577,422 entitled ATHLETIC SHOE WITH IMPROVED PIVOT CLEATING.

FIELD OF THE INVENTION

This invention is related generally to athletic shoes of the type having cleats, such as football shoes, and, more specifically, to athletic shoes for use on artificial turf.

BACKGROUND OF THE INVENTION

Most athletic shoes used for field sports, such as football, baseball, softball, soccer, rugby and lacrosse, have a number of projections or cleats for the purpose of increasing traction. (The terms "cleats" and "projections" will be used interchangeably herein.) Cleats penetrate the turf to prevent slipping during starting, stopping, and cutting maneuvers.

Such projections, however, in addition to providing desirable traction for starting, stopping and cutting, typically provide very undesirable resistance to pivoting. This can be a disadvantage in two ways.

When pivoting is inhibited, the maneuverability of an athlete is limited. His performance is less than it could be. Enhancing the ability of a player to pivot can greatly increase his effectiveness on the field.

In addition to inhibiting certain athletic pivoting actions, projections or cleats of the prior art tend to resist tension-relieving pivoting when unwanted torque or force is applied to the athlete, particularly to a leg. If a leg is forcibly twisted when the cleats have penetrated into the turf, and the foot is held firmly on the turf, the projections or cleats can prevent pivoting and thereby lead to injuries, particularly common knee injuries.

While athletic shoes for use on artificial turf typically have cleats or projections of shorter length than shoes for natural grass, the same problems are experienced. Athletic shoes for artificial turf playing surfaces typically compensate for the reduced length of their cleats or projections by increasing the number of projections. The problems mentioned above are present in varying degrees in shoes designed for use on artificial turf, and improved pivot cleating is needed for such shoes. Indeed, even with flat-soled artificial turf shoes, pivoting is often strongly resisted; this may be because of surface adhesion, rather than penetration.

A wide variety of attempts have been made in the past to make an athletic shoe which would improve pivoting. Among these are shoes with separate spikes or widely spaced arced edges and shoes with fixed annular cleats. Those with separate spikes or widely spaced arced edges tend to resist pivoting. This invention relates generally to constructions having fixed annular cleats.

Prior art shoes of the latter type, having continuous annular cleats, have failed to provide adequate gripping action and/or have failed to provide adequate pivoting action for several specific reasons. Such shoes have not been accepted by athletes and have not been widely in use.

The deficiencies of such prior art shoes and the unique characteristics and advantages of this invention can most easily be described with reference to the foot of the athlete. The sole of the foot includes four basic portions. They are, in order back to front: the heel portion; the arch portion; the ball-of-the-foot portion; and the toe portion. The heel portion and the ball-of-the-foot portion are those portions which share most if not all of the player's weight when the player is in a normal standing position with his feet generally flat on the ground. In such position, the arch portion of the sole bears little if any weight, and the toe portion bears little if any weight.

When a player is "on his toes" in a "ready" position, virtually all of the player's weight is normally shared by the toe and ball-of-the-foot portions. The same is usually true when a player is "digging" in a running action. Indeed, when a player is in the ready position, the juncture of the phalanges (toe bones) and the metatarsles is the center of weight bearing. In other words, the center of weight bearing in the forward portions of the foot actually moves forward when a player shifts to the ready position.

The sole of an athletic shoe has portions immediately below such four foot portions which may be designated, and herein are designated, by the same terms.

Prior art shoes having annular cleating fail to function properly at least in part because of grossly improper placement of an annular cleat—much too far back from the juncture of the toe and ball-of-the-foot portions where weight is centered in the ready position. Indeed, in the ready position, normally the only position in which pivoting is important, such prior shoes would pivot little better than shoes with the standard blade-like or tapered cleats.

Further affecting the performance of some of the prior art shoes with fixed annular cleats is the fact that a portion of the sole enclosed by the annular cleat is raised above the main sole surface, thus preventing complete penetration of the cleats into the turf and limiting the available traction. Another drawback is the small diameter of some annular cleats. Such cleats do not provide a wide-based bearing on the ground, causing instability and insufficient pivoting and traction.

Without further elaboration on the shortcomings of prior athletic shoes, it can be said that prior shoes have failed to provide a combination of good traction and good pivotability. There has been a strong, unsatisfied need for an improved athletic shoe for field sports, including a need for shoes providing improved pivotability with good stability and traction on artificial turf playing surfaces.

BRIEF SUMMARY OF THE INVENTION

This invention is an improved athletic shoe for field sports conducted on artificial turf. The invention provides good traction without sacrificing pivotability, and improved pivotability without sacrificing traction.

The sole of the shoe of this invention includes at least three substantially concentric annular projections (or "cleats"), each terminating in circular edges. One of these is a first projection substantially encompassing the ball-of-the-foot and toe portions of the sole and extending across substantially the entire width of the sole. Such first annular projection, and the others concentric with it, are centered about the juncture of the phalanges and the metatarcles, that is, at the juncture of the ball-of-the-foot and toe portions of the sole.

The other annular projections, of which there are at least two, preferably more than two and most preferably at least six, at spaced inwardly at successively shorter radii, all around a common center. Such annular projections are preferably spaced at equal radial intervals in a pattern substantially covering the ball-of-the-foot and toe portions of the sole.

Such annular projections enclose sole portions which are substantially coincident with the main sole surface; that is, the enclosed sole surface is not built up substantially from the main sole surface. This allows the annular projections to fully penetrate the artificial turf to give good traction.

The distal edges of such annular projections are spaced from the main sole surface by from about 3 to about 8 mm, and most preferably, by from about 5 to about 7 mm. In highly preferred embodiments, the cross-sectional shapes of the annular projections are substantially congruent one to another, and constant at substantially all points therealong.

Some preferred embodiments also include at least one and preferably two or more truncated-circle projections which are concentric with the first full projection, but placed at a greater radial location. That is, such truncated-circle projection or projections will be outside the first projection, but are centered on the same center point.

The truncated-circle projections have truncated-circle edges preferably spaced from the main sole surface by the same distance as the full-circle projections. Their cross-sections are also preferably of the same shape.

The truncated projections, at their greater radial locations, can be in the tip of the toe area of the sole and/or in the back of the ball-of-the-foot area. The full annular projections are the principal functioning cleats, providing the superb combination of pivoting and traction. The truncated-circle projections play a secondary role, providing support and some traction without detracting from pivoting performance.

The annular projections and truncated-circle projections have radially inward and outward lateral surfaces converging to their circular or truncated-circular edges. The outward lateral surfaces are preferably normal (i.e., perpendicular) to the main sole surface, with the radially inward lateral surfaces flaring radially outwardly to converge with the outward surfaces at the distal edges. This configuration is preferred for giving superior traction. Alternatively, the inward and outward surfaces can both be angled toward each other in a V-shaped cross-section; this configuration can provide superior strength.

The circular edges of the annular projections, and the truncated-circular edges of the truncated-circle projections, are preferably sharp. That is, there is little or no "flat" along the surface. Penetration into the artificial turf is somewhat easier when such edges are sharp in this manner.

In certain preferred embodiments of this invention, there are narrow breaks in the substantially continuous annular projections at the intersections of such projections with an imaginary chord line across the sole. Such breaks, which are most preferably slits, facilitate bending of the sole along such chord line. Each annular projection has two breaks for each chord line, and may be intersected by more than one such imaginary line. The breaks preferably extend from the circular edges of the annular projections substantially to the main sole surface.

The projections are preferably themselves flexible to facilitate flexing of the sole. Such projections are preferably integrally molded with the main sole surface.

Greatly improved pivoting on artificial turf is possible using the shoes of this invention. This is demonstrated dramatically in certain common moves in football, such as the spinning movements of offensive running backs and defensive pass rushers and the "pulling" action of an offensive guard on sweeps and trap plays, to name just a few.

More generally, a wide variety of "moves" in many field sports are greatly facilitated and/or accelerated by the shoe of this invention, and innovative playing techniques are made possible. Prior athletic shoes have not provided the dramatic advantages which are provided by this invention.

And, as previously indicated, the frequency of certain common leg injuries can be reduced by use of this invention.

The greatly improved pivotability is achieved without any sacrifice in traction. Indeed, the stopping and starting traction provided by the artificial turf shoe of this invention is significantly improved over the prior art.

OBJECTS OF THE INVENTION

It is an object of this invention to provide an athletic shoe for field sports conducted on artificial turf which will reduce injuries, particularly knee injuries.

Another object of this invention is to provide an athletic shoe giving improved pivotability on artificial turf without sacrificing traction.

Another object of this invention is to provide an athletic shoe giving both good traction and good pivotability on artificial turf.

Another object of this invention is to provide an artificial turf athletic shoe which allows easy pivoting when the foot is in the ready position with weight being borne by the toe and ball-of-the-foot portions.

These and other objects will be apparent from the following additional descriptions including the drawings, wherein:

DETAILED DESCRIPTIONS OF PREFERRED EMBODIMENTS

Figure 6:
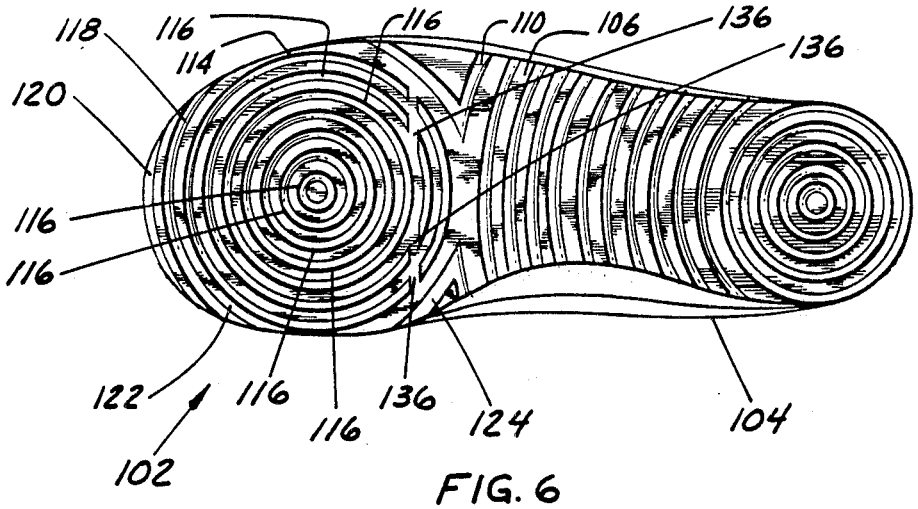
FIG. 6 is a fragmentary plan view of the sole of an alternate embodiment.
Figure 1:
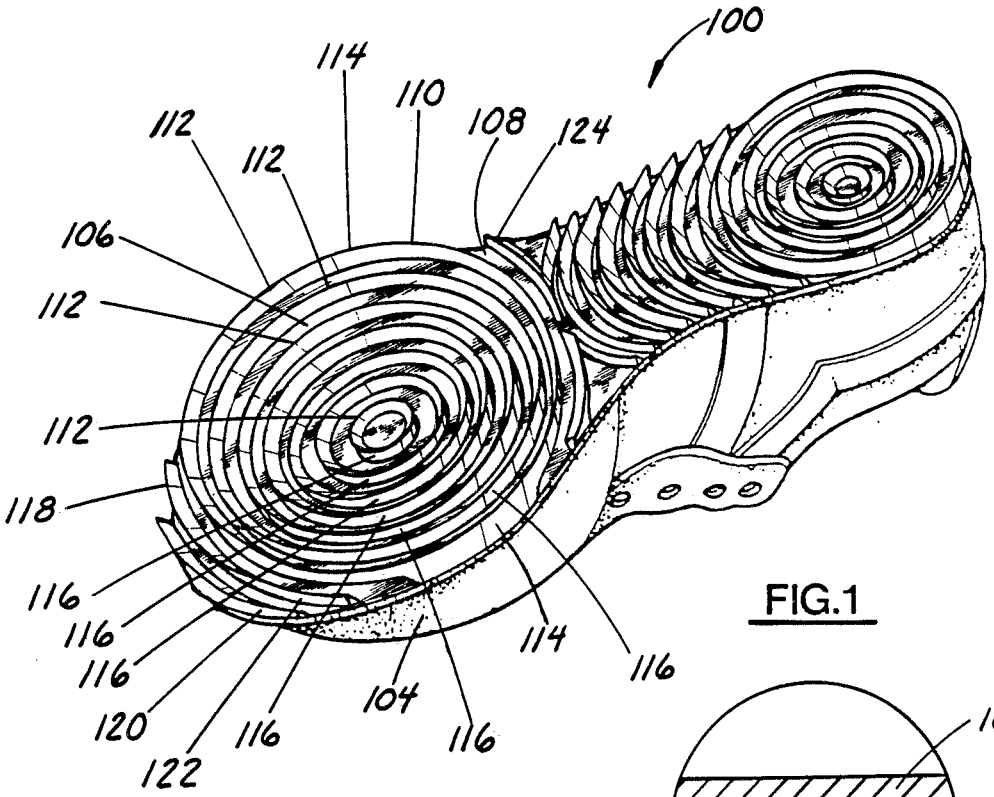
FIG. 1 is a perspective view of a preferred athletic shoe in accordance with this invention.

FIGS. 1, 2, 4, 5 and 7 illustrate an athletic shoe 100 in accordance with a preferred embodiment of the invention. FIG. 6 illustrates another preferred embodiment 102. In such embodiments, like parts are identified by the same numbers.

Shoe 100 has an upper 104 and a sole 106 affixed together in the normal way. The make-up of upper 104 is not a part of this invention, and it may be made of conventional materials such as leather, canvas and the like. Sole 106 is made of material which is tough and wear-resistant but which can flex in the normal manner depending on how weight is applied to it. Sole 106 is preferably formed of polyurethane or rubber.

The lower surface of sole 106, which contacts the artificial turf playing surface, includes a main sole surface 108, which is a generally flat even surface or a generally flat textured surface, and a number of cleats or projections 110 extending from the main sole surface 108. Projections 110 are preferably integrally formed with main sole surface 108 in a molding process.

Figure 3:
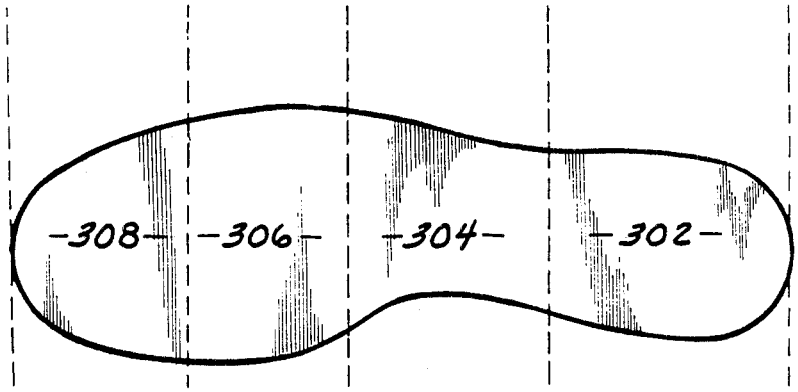
FIG. 3 is a cleatless schmatic plan view of an athletic shoe sole, illustrating the portions thereof.
Figure 4:
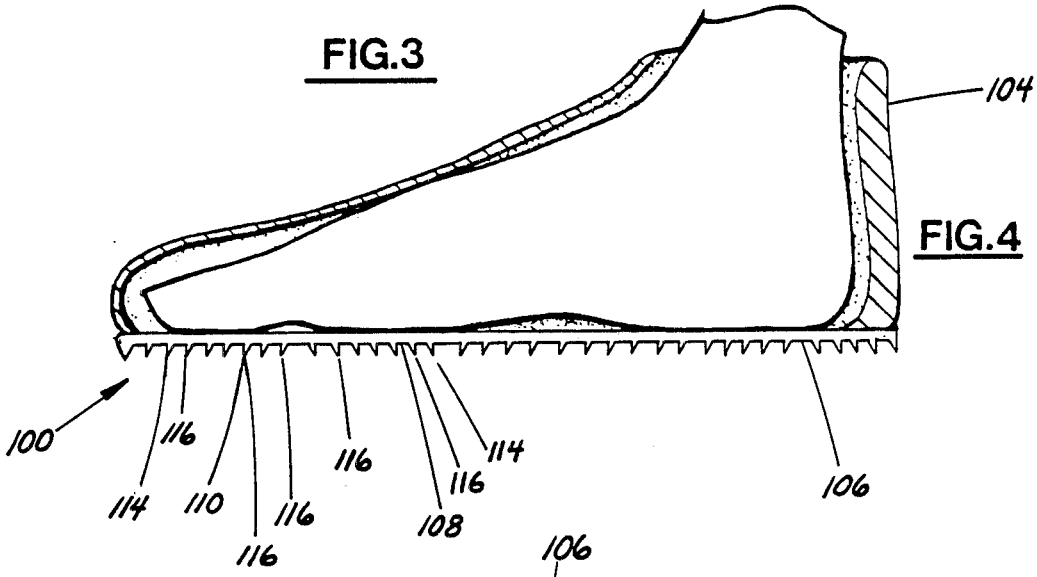
FIGS. 4 and 5 are full-shoe (with foot) and heel-only sectionals taken along sections 4—4 and 5—5, respectively, as indicated in FIG. 2.
Figure 5:
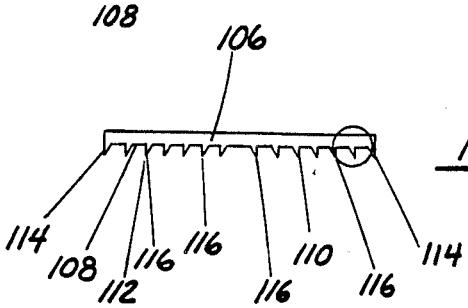

As illustrated in aligned FIGS. 3 and 4, the sole has four portions which are defined by the portions of the foot adjacent to them. These sole portions are: a heel portion 302, immediately below the player's heel; an arch portion 304, below the arch of the player's foot; a ball of-the-foot portion 306, below the ball of the player's foot; and a toe portion 308, below the player's toes.

As previously noted, the ball of the foot and the heel bear weight when the player is standing in a flat-footed stance, as in FIG. 4, while the toe and ball of the foot portions bear weight when the player is in the ready position.

Among the projections 110 are a series of seven concentric continuous full-circle annular projections 112. Annular projections 112 are centered at the juncture of the ball-of-the-foot and toe portions of the sole. The concentric annular projections 112 include a first annular projection 114, which has the largest radius of the full-circle annular projections 112, and six additional smaller annular projections 116, spaced at successively shorter radial locations.

First annular projection 114 substantially encompasses the ball-of-the-foot and toe portions 306 and 308 and extends substantially across the width of sole 106. The six additional annular projections 116 are spaced at equal radial intervals at successively shorter radial locations at positions toward the mid-line of the sole. It is preferred to have more than two of such additional annular projections 116 and most preferred to have six or more.

Also located on sole 106 are truncated-circle projections 118 and 120. These are along parts of circles which are concentric with annular projections 112 but located on greater radii. By virtue of their curvature and narrowness, these projections facilitate pivoting, even though the player's weight is borne mainly by the full annular projections 112. A forward portion 122 of truncated-circle projection 118 is spaced just beyond first annular projection 114 near the forward end of sole 106. A rearward portion 124 of truncated-circle projection 118 is spaced just beyond first annular projection 114 near the arch portion of sole 106. Truncated-circle projection 120 is the forwardmost projection and extends along a smaller arc than forward portion 122 of projection 118.

Rearwardly from that point are a series of additional projections which do not play an important role in providing the pivotability which is characteristic of the shoe of this invention. Among these are a series of annular projections on heel portion 302 of sole 106. While these are shown as annular projections centered on heel portion 302, other forms of gripping projections may be used in the heel area.

Figure 7:
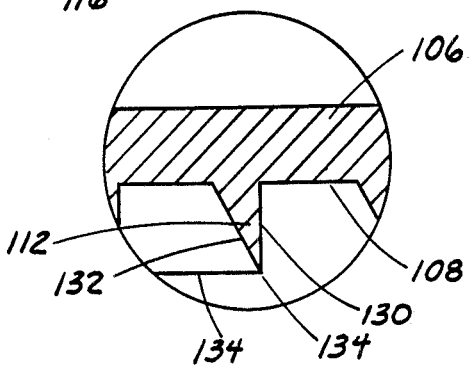
FIG. 7 is a magnified view of a portion of FIG. 5.
Figure 2:
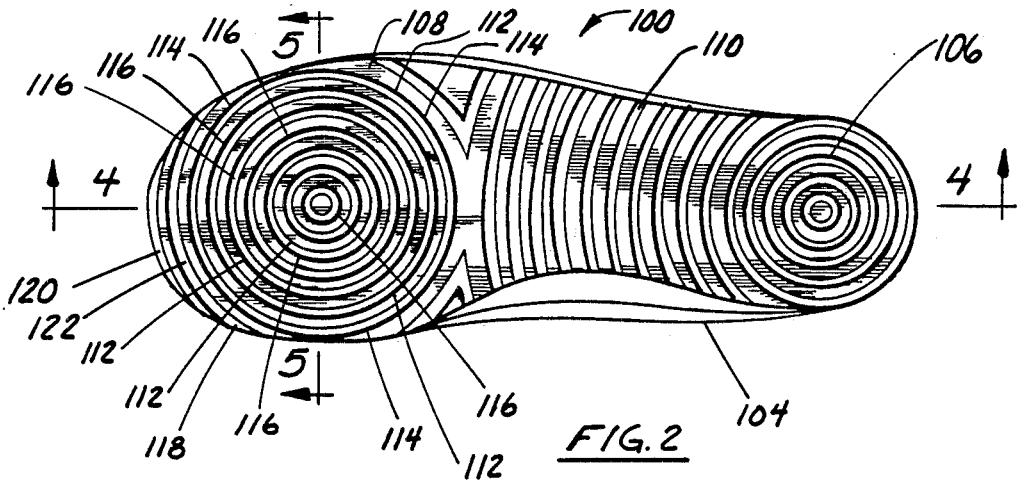
FIG. 2 is a plan view of the sole of the shoe of FIG. 1.

As shown best in FIG. 7, annular projections 112 have radially-outward and radially-inward annular surfaces 130 and 132, respectively, which converge together in distal edges 134. Distal edges 134 of annular projections 112 are circular and relatively sharp. That is, the distal edges have very little flatness. Their sharpness makes turf penetration easier.

Distal edges 134 are evenly spaced from main sole surface 108. Distal edges 134 are preferably spaced from main sole surface 108 by from about 3 to about 8 mm. In the most preferred embodiments, such spacing is from about 5 to 7 mm. Thus, annular projections 112 are more than merely a tread design; they are a series of short cleats having a significant effect on shoe performance. They provide a superb combination of pivotability and traction to the athlete.

The edges of the truncated-circle projections 118 and 120 have the same spacing from main sole surface 108 as do distal edges 134 of annular projections 112.

The radially outward annular surfaces 130 of annular projections 112 are preferably normal (that is, perpendicular) to main sole surface 108. However, other angular configurations are acceptable. It is desirable to make annular projections 112 of sufficient width at their points of attachment to main sole surface 108, and sufficiently blunt near distal edges 134, such that they will wear well and not tend to break off.

As noted above, annular projections 112 and truncated-circle projections 118 and 120 are preferably of the same flexible material as the main portion of sole 106. This allows good flexing of sole 106 during running action.

Annular projections 112 are the only projections from the main sole surface 108 in the area which they cover. That is, the sole portion enclosed by first annular projection 114 is substantially coincident with main sole surface 108, except of course of the additional annular projections 116.

The cross-sectional shapes of annular projections 112 and truncated-circle projections 118 and 120 are substantially congruent at any point along their lengths.

In the embodiment of this invention illustrated in FIG. 6, there are breaks 136 in annular projections 112 where such projections intersect with a chord line across sole 106. Breaks 136 facilitate bending of a sole 106 along such chord line. In addition, these and other small breaks along the substantially continuous annular projections 112 can be a controlling factor for pivotability.

While the principles of this invention have been described in connection with specific embodiments, it should be understood clearly that these descriptions are made only by way of example and are not intended to limit the scope of this invention.

What is claimed is:

1. In an athletic shoe of the type with a sole for use on artificial turf, said sole having heel, arch, ball-of-the-foot and toe portions, a main sole surface and projections to provide traction, the improvement comprising:

at least three substantially concentric annular projections centered substantially on the juncture of the ball-of-the-foot and toe portions of the sole and terminating in substantially circular distal edges, including a first annular projection extending substantially across the width of the sole and at least two additional annular projections spaced at successively shorter radial locations;

said annular projections being flexible to allow flexing of the sole;

said annular projections having inner and outer annular surfaces angled with respect to the main sole surface and extending to intersection with said main sole surface; and said annular projections enclosing a sole area substantially all portions of which not on said annular projections are coincident with said main sole surface, whereby both improved pivotability and traction are provided.

2. The athletic shoe of claim 1 having more than two of said additional projections.

3. The athletic shoe of claim 2 having at least six additional projections.

4. The athletic shoe of claim 1 further including at least one truncated-circle projection concentric with said first projection and at a greater radial location.

5. The athletic shoe of claim 4 having at least two of said truncated-circle projections spaced from said first projection at successively greater radial locations.

6. The athletic shoe of claim 4 wherein the cross-sectional shapes of the annular projections and truncated-circle projections are substantially congruent.

7. The athletic shoe of claim 1 wherein the distal edges of the annular projections are spaced from said main sole surface by from about 3 to about 8 mm.

8. The athletic shoe of claim 6 wherein the distal edges of the annular projections are spaced from said main sole surface by from about 5 to about 7 mm.

9. The athletic shoe of claim 1 wherein the outer annular surfaces are substantially normal to said main sole surface.

10. The athletic shoe of claim 9 wherein the distal edge is a sharp edge.

11. The athletic shoe of claim 1 wherein the cross-sectional shapes of the annular projections are substantially congruent.

12. The athletic shoe of claim 1 wherein the projections are integrally molded with the sole.

13. The athletic shoe of claim 12 wherein there are breaks in the annular projections at the distal edges thereof.

14. The athletic shoe of claim 13 wherein such breaks are at the intersections of the annular projections with a chord line across the sole to facilitate bending of the sole along such chord line.

* * * * *